United States Patent [19]

Gonzalez et al.

[11] 4,037,069

[45] July 19, 1977

[54] MAT SWITCH

[76] Inventors: Roland Gonzalez; Raul C. Miguel, both of 135 NE. 134th St., N. Miami, Fla. 33161

[21] Appl. No.: 633,607

[22] Filed: Nov. 20, 1975

[51] Int. Cl.[2] ..... H01H 13/16

[52] U.S. Cl. ..... 200/86 R

[58] Field of Search ..... 200/86 R; 340/272

[56] References Cited

U.S. PATENT DOCUMENTS

| | | | |
|---|---|---|---|
| 1,776,992 | 9/1930 | Brockman | 200/86 R |
| 3,718,791 | 2/1973 | Szablowski | 200/86 R |

*Primary Examiner*—David Smith, Jr.

[57] ABSTRACT

A mat switch includes top and bottom cardboard sheets having opposed faces on which are formed complementary electrodes. Each electrode is a plurality of elongated generally parallel first bands of metal foil adhesively secured to the opposed faces which are electrically interconnected by a pair of second bands perpendicularly directed to the first bands. A relatively thin dielectric sheet is laminated between the opposed faces and includes a plurality of parallel elongated apertures in register with the first bands.

1 Claim, 2 Drawing Figures

40
12
32
14
10
46
34
16
38
42
44

28
10
12
22
26
32
28
18
30
14
28
16
36
26
24
32
20
28

MAT SWITCH

FIELD OF THE INVENTION

The present invention relates generally to pressure responsive mat switches. In its particular aspects, the present invention relates to the provision of opposed electrodes in the form of a plurality of spaced apart electrically conductive bands between which is sandwiched a dielectric sheet having a plurality of elongated apertures in register with the bands.

BACKGROUND OF THE INVENTION

Pressure responsive mat switches are utilized in alarm systems to detect the presence of intruders. Such prior art mat switches are expensive of construction and as such are not generally feasible for use in domestic contexts associated with the elderly, children or disturbed individuals who may try to evade the care or control which they are under.

OBJECTS OF THE INVENTION

It is an object of the present invention to provide a simple and inexpensive mat switch.

It is a further object of the present invention to provide a mat switch composed of deformable cardboard sheets carrying bands of metal foil as electrodes.

SUMMARY OF THE INVENTION

Briefly, the aforementioned and other objects of the present invention are satisfied by providing a pressure responsive mat switch formed by top and bottom cardboard sheets between which is sandwiched a dielectric sheet. Electrodes are formed on the opposed faces of the cardboard sheets by a plurality of elongated parallel metal foil bands which are adhesively secured thereto.

The bands are spaced apart but are electrically interconnected by other metal foil bands running perpendicular to the aforementioned bands along the opposite extremes thereof. The dielectric sheet has a plurality of spaced apart elongated apertures in register with the parallel bands on the opposed faces of the cardboard sheets.

When pressure is applied on the top cardboard sheet, bands below the point of pressure application are brought into contact through the aperture by deformation of the top cardboard sheet.

For distributing the pressure which may be applied to the mat switch, it is encased in a foamed plastic jacket.

Other objects, features and advantages of the present invention will become apparent upon perusal of the following detailed description of the preferred embodiment thereof when taken in conjunction with the appended drawing wherein:

FIG. 1 is a pictorial exploded view of the mat switch of the present invention; and FIG. 2 is a combined elevational cross-sectional view of the mat switch of the present invention and a schematic of an alarm circuit therefor.

DETAILED DESCRIPTION

Figures 1, 2:
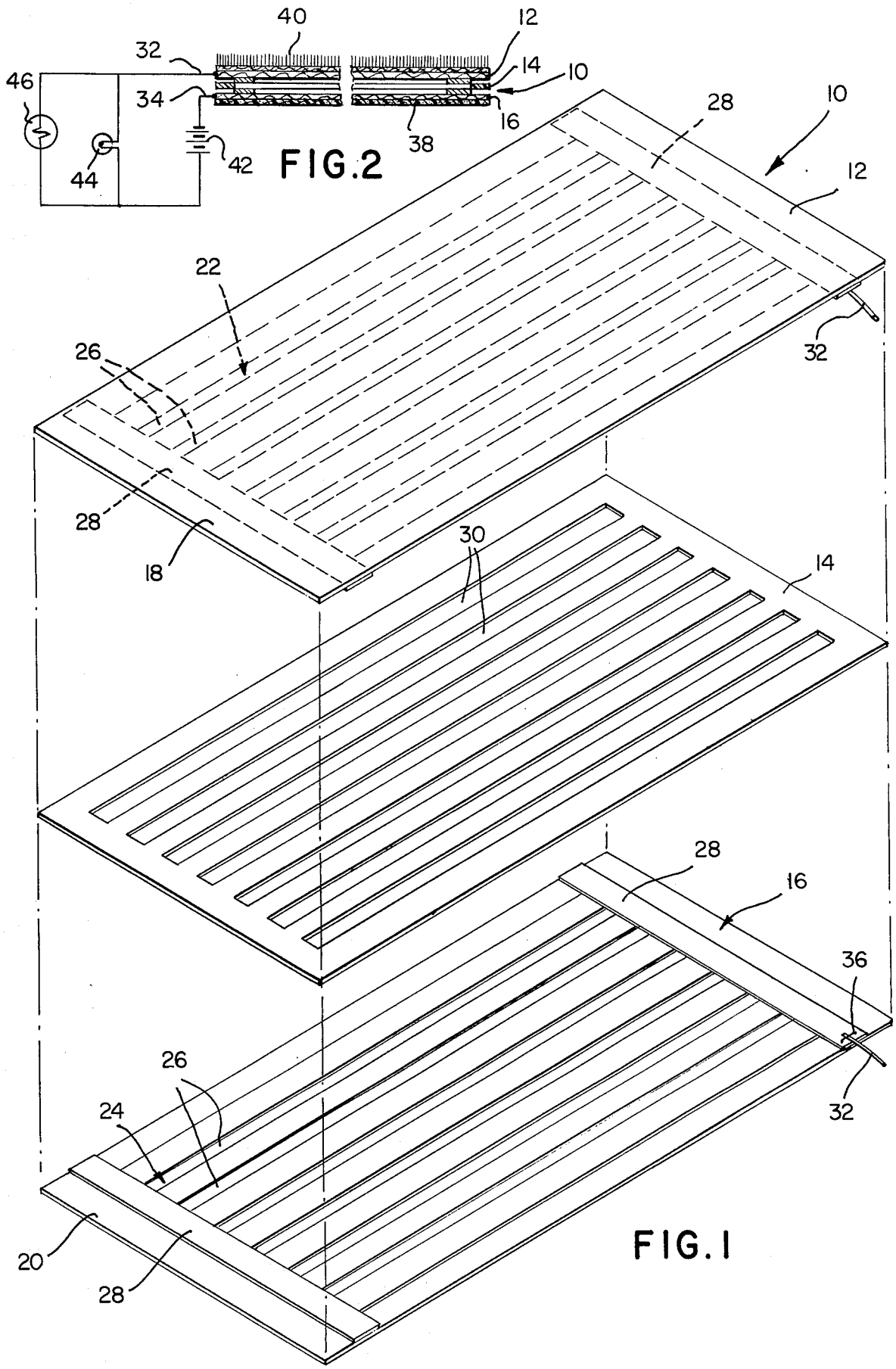

Referring to FIGS. 1 and 2 of the drawing, the mat switch of the present invention is generally indicated by the reference numeral 10. Mat 10 is generally a sandwich or lamination of three rectangular sheets 12, 14, and 16 of the same area. Sheets 12–16 are preferably 2 by 4 feet. The top and bottom sheets 12 and 16 are preferably cardboard such as millboard or pasteboard of about one sixteenth inch in thickness. The center sheet

14 is a relatively thin plastic dielectric such as 5 inch thick acetate.

Cardboard sheets 12 and 16 have opposed faces 18 and 20 on which are respectively formed complementary electrodes 22 and 24. The electrodes 22 and 24 are each composed of a plurality of spaced apart parallel bands or strips 26 of aluminum foil tape adhesively secured to the opposed faces 18 and 20. The band 26 are directed along the longer dimension of the sheets 12 and 14 and are preferably 2 inches in width and spaced apart on 3 inch centers.

Running perpendicular to bands 26 along the opposite extremes of the bands are other metal foil bands 28 for electrically interconnecting the bands 26 on each of the sheets 12 and 16. Further, the bands 26 on each of the sheets are positioned so that corresponding bands are in register with each other. A plurality of generally parallel elongated apertures or slots 30 are provided spaced apart on three inch centers in sheet 14 in register with bands 26. Slots 30 are preferably one inch in width.

Thus, when pressure is applied on top of sheet 12, the sheet will be deformed under the pressure area so that at least one band 26 on sheet 12 will contact a corresponding band 26 on sheet 16 through aperture 30. To utilize this pressure responsive contact in an alarm circuit, leads 32 and 34 are respectively secured to bands 28 on sheets 12 and 16 by metal staples 36.

For distributing the pressure applied to mat 10 as by a heel to prevent damage to the mat, the entire mat 10 is preferably encased in a jacket 38 of polystyrene plastic foam. The mat 10 is suitable to be placed under a floor covering such as a rug 40. To enable detection of the presence of someone walking on rug 40 directly over mat 10, the leads 32 and 34 are connected in series with a source of relatively low voltage such as a battery 42. The series combination of mat switch 10 and battery 42 is connected in parallel with a lamp 44 and buzzer 46 which are energized in response to the application of pressure to mat 10.

It should be appreciated that what has been described is an extremely simple and inexpensive mat switch. While the preferred embodiment thereof has been described in specific detail, many modifications, additions and omissions of these details are possible within the intended spirit and scope of the invention claimed herein.

What is claimed is:

1. A mat switch comprising: top and bottom flexible dielectric sheets on which are respectively formed opposed top and bottom planar complementary electrodes adapted to contact each other in response to pressure on said top sheet; said top and bottom electrodes being formed of spaced apart generally parallel elongated first metal foil bands adhesively secured respectively to said top and bottom sheets, the first bands of said top electrode being in register with the first bands of said bottom electrode; amiddle dielectric sheet sandwiched between said top and bottom electrodes; said middle sheet having a plurality of spaced apart generally parallel elongated apertures in register with said first bands; said first and second electrodes each further comprising a pair of second metal foil bands running perpendicular to and overlapping the first bands along opposite extremes of said first bands; first and second lead wires; a first metal staple attaching said first lead wire to one of the second bands of said top electrode; and a second metal staple attaching said second lead wire to one of second bands of said bottom electrode.

* * * * *